US009550196B2

(12) United States Patent
Schulte

(10) Patent No.: US 9,550,196 B2
(45) Date of Patent: Jan. 24, 2017

(54) SHOWER SYSTEM WITH FLOW RESTRICTION

(71) Applicant: Grohe AG, Hemer (DE)

(72) Inventor: Michael Schulte, Menden (DE)

(73) Assignee: Grohe AG, Hemer (DE)

( * ) Notice: Subject to any disclaimer, the term of this patent is extended or adjusted under 35 U.S.C. 154(b) by 853 days.

(21) Appl. No.: 13/866,519

(22) Filed: Apr. 19, 2013

(65) Prior Publication Data

US 2013/0283520 A1 Oct. 31, 2013

(30) Foreign Application Priority Data

Apr. 27, 2012 (DE) ..... 10 2012 008 407

(51) Int. Cl.

| | |
|---|---|
| ***A47K 3/022*** | (2006.01) |
| ***B05B 1/30*** | (2006.01) |
| ***E03C 1/04*** | (2006.01) |
| ***F16L 55/027*** | (2006.01) |

(52) U.S. Cl.

CPC ..... *B05B 1/30* (2013.01); *E03C 1/0408* (2013.01); *F16L 55/027* (2013.01)

(58) Field of Classification Search

USPC ..... 239/443–444; 4/615–618, 601; 138/45

See application file for complete search history.

(56) References Cited

U.S. PATENT DOCUMENTS 4,244,526 A * 1/1981 Arth ..... B05B 1/3006 137/517
7,043,776 B1 * 5/2006 Wu ..... E03C 1/0408 4/601
7,543,763 B1 * 6/2009 Wu ..... B05B 1/3006 138/45
8,066,204 B2 * 11/2011 Petrovic ..... B05B 1/1609 239/443
2007/0033729 A1 * 2/2007 Faux ..... E03C 1/06 4/601
2009/0265848 A1 * 10/2009 Tsai ..... E03C 1/06 4/615
2013/0081730 A1 * 4/2013 Schwartz ..... E03C 1/021 138/44

FOREIGN PATENT DOCUMENTS

DE 203 19 169 U1 4/2004

* cited by examiner

*Primary Examiner* — Lauren Crane

(74) *Attorney, Agent, or Firm* — Muncy, Geissler, Olds & Lowe, P.C.

(57) ABSTRACT

A shower system with a wall connection, a conduit connected thereto to connect the wall connection to a changeover device, and an overhead shower head and a hand shower to which water can be supplied via the changeover device. A first flow restrictor with a first flow restriction is disposed in an area of the wall connection and a second and third flow restrictor are disposed in an area of the overhead shower head and hand shower in a series connection. In the area of the changeover device at least one fourth flow restrictor with at least one second flow restriction is provided and the changeover device provides at least one first direct line connection between the wall connection and at least the overhead shower head or hand shower and a second indirect line connection with a series connection of the fourth flow restrictor.

9 Claims, 4 Drawing Sheets

SHOWER SYSTEM WITH FLOW RESTRICTION

This nonprovisional application claims priority under 35 U.S.C. §119(a) to German Patent Application No. DE 10 2012 008 407.2, which was filed in Germany on Apr. 27, 2012, and which is herein incorporated by reference.

BACKGROUND OF THE INVENTION

Field of the Invention

The present invention relates to a shower system with a wall connection, a conduit connected thereto, which connects the wall connection to a changeover device, and an overhead shower head and a hand shower to which water can be supplied alternatively via the changeover device, whereby a flow restrictor limits the maximum flow rate. The invention is used in sanitary facilities and here particularly in showers and baths.

Description of the Background Art

U.S. Pat. No. 7,043,776 B1 discloses a shower system with an overhead wall connection. The user of the shower system can convey the water via a changeover device alternatively through an overhead shower head or a hand shower. A defined setting of the flow rate below a maximum allowable flow rate is difficult or not possible with prior-art systems.

SUMMARY OF THE INVENTION

It is therefore an object of the invention to solve the problems arising from the state of the art and to provide a shower system, which is especially simple and simultaneously has improved setting options for the flow rate below a maximum flow rate restriction.

In an embodiment, an object is attained by a shower system that has a first flow restrictor with a first flow restriction disposed in an area of the wall connection and a second and third flow restrictor disposed in an area of the overhead shower head and hand shower functionally in a series connection. In an area of a changeover device at least one fourth flow restrictor with at least one second flow restriction is provided and the changeover device provides at least one first direct line connection between the wall outlet and at least the overhead shower head or hand shower and a second indirect line connection with a series connection of the fourth flow restrictor.

The present invention provides, apart from the known direct line connections between the wall outlet and the discharge sites, at least one additional line connection, which connects another flow restrictor with a second flow restriction in series. In this regard, the line connection can run from the wall connection alternatively to an overhead shower head or a hand shower. If now the first direct line connection is selected, the flowing water volume is limited solely by the first flow restrictor in the area of the wall connection and the second or third flow restrictor in the area of the overhead shower head or hand shower. If the user now operates the changeover device and selects the second indirect line connection with the series connection of the fourth flow restrictor, the flowing water volume is limited in addition by the fourth flow restrictor. The basic principle of the present invention thus provides connecting or bypassing an additional flow restrictor alternatively in a series connection to an overhead shower head or hand shower.

In an embodiment of the invention, it is provided that the wall connection can be a mixed water connection. In this case, the already premixed water with the desired temperature exits at the wall connection and only a distribution function and volume regulation are provided within the shower system.

In addition, it can be advantageous in an embodiment, if the second flow restriction provides a lower flow rate than the first flow restriction. If, for example, the first flow restriction with a maximum flow rate of less than 4 US gallons and particularly of 2.5 or 2 US gallons per minute and the second flow restriction with a flow rate of less than 1.5 US gallons and particularly of 1.32 US gallons per minute are selected, thus an appropriate and defined flow rate reduction can be achieved with the shower system of the invention in an especially simple way, without the user having to undertake involved and uncomfortable adjustment measures. In particular, an inadvertent excessive restriction of the flow rate, which is possible in prior-art systems, can be avoided. The showering process and the setting or switching of the line connections thus become clearly more comfortable. Furthermore, the acceptance and thereby the potential for saving water by users can be considerable improved by the simplified operation.

The shower system can be designed in addition so that the fourth flow restrictor is integrated into the changeover device. The installation space already available there can be utilized optimally in this way. In addition, with a suitable selection of conduit paths within the changeover device one and the same flow restrictor can be connected or bypassed alternatively in the second indirect line connection to the overhead shower head or to the hand shower.

In an embodiment, it is provided further that the changeover device has at least three switching states, of which at least one switching state connects the fourth flow restrictor in series and thus causes the second flow restriction of the flow rate. In the simplest embodiment the invention, therefore, two first line connections between the wall outlet and an overhead shower head or a hand shower can be provided and at least one third line connection, which is configured with a series connection of the fourth flow restrictor as an indirect line connection. The third line connection can lead either to a hand shower or an overhead shower head. An alternative embodiment of the invention can provide a fourth line connection, which is also configured as an indirect line connection, so that both for controlling the overhead shower head and also the hand shower in each case an indirect or a direct line connection can be selected by means of the changeover device.

It is furthermore advantageous if the wall connection is disposed above the changeover device. In certain geographic regions, overhead wall connections as the water outlet are found especially frequently. In this case, it is advantageous to dispose the changeover device below this wall connection in order to increase the ease of use for the user of the shower. It is therefore possible in addition to retrofit the shower system of the invention easily to existing overhead wall connections.

In this context, it is also advantageous if the conduit is made dual-flow at least in part. Dual-flow here can mean that in at least one section of the used conduit two conduit channels are realized through which the water or mixed water can be conveyed. In this way, it is possible, for example, with only a single conduit to convey water from the overhead wall connection downward to the changeover device and then through the second conduit channel of the conduit again back upwards to an overhead shower head.

Finally, the switching states of the changeover device can be configured so that a steady change in the flow rate occurs within the limits of the first and second flow restriction. If the changeover device is designed, for example, as a rotary knob, it is expedient to arrange the switching states with the first flow restriction adjacent to one another and to arrange the switching states of the second flow restriction also adjacently. If the changeover device is equipped, for example, with four switching states, thus beginning with an overhead shower head of the first flow restriction another switching state can follow in which the overhead shower head experiences a second reduced flow restriction, then a third switching state in which the hand shower experiences a reduced second flow restriction, and thereupon a fourth switching state in which the hand shower has the first flow restriction. In this respect, both the states of the first flow restriction and the states of the second flow restriction are each arranged adjacent to one another and a steady change in the flow rates can occur. The steady change in flow rate, in connection with the present invention, is understood to be the continuous and not abrupt change in flow rate. This can be achieved, for example, in that with a change from one switching state to another switching state in the transition phase both affected line connections are opened at least partially and during the changeover process the flow rate experiences a steady and continuous change. This can be achieved by the suitable simultaneous opening and closing of the particular line connections.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
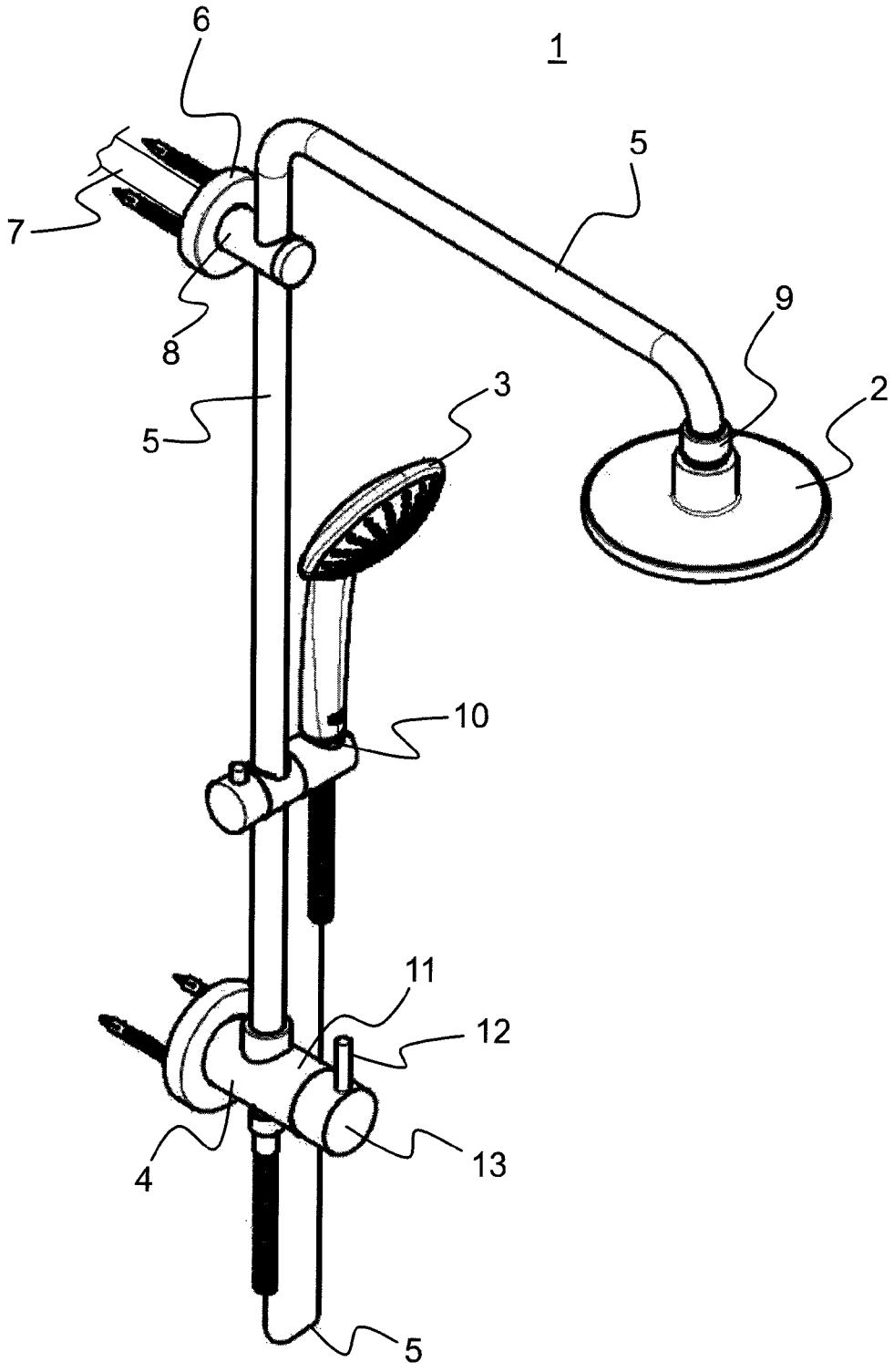
FIG. 1 illustrates an embodiment of a shower system of the invention in a perspective view.

A shower system 1 of the invention is shown in a perspective oblique view in FIG. 1. Shower system 1 has an overhead shower head 2 and a hand shower 3. In the bottom area, there is a changeover device 4, which is connected to overhead shower head 2 and hand shower 3 by conduit 5. In the upper area, there is further a wall connection 6, which is connected to a mixed water line 7. A first flow restrictor 8 with a first flow restriction is provided in addition in the area of wall connection 6. Furthermore, there is a second flow restrictor 9 at overhead shower head 2 and a third flow restrictor 10 at hand shower 3. Moreover, a fourth flow restrictor 11 is integrated into the housing of changeover device 4. Changeover device 4 has a control lever 12 with which the user can set the desired switching states. Control lever 12 engages a rotary knob 13, by which a rotation is transmitted to changeover device 4. To carry out the shower process, a user must first set the desired mixed water temperature. This occurs outside the shower device at the start of the mixed water line 7. Next, by operating changeover device 4 and selecting a desired switching state, the user can carry out the showering process with the desired first or second flow restriction alternatively with the hand shower or overhead shower head.

Figure 2:
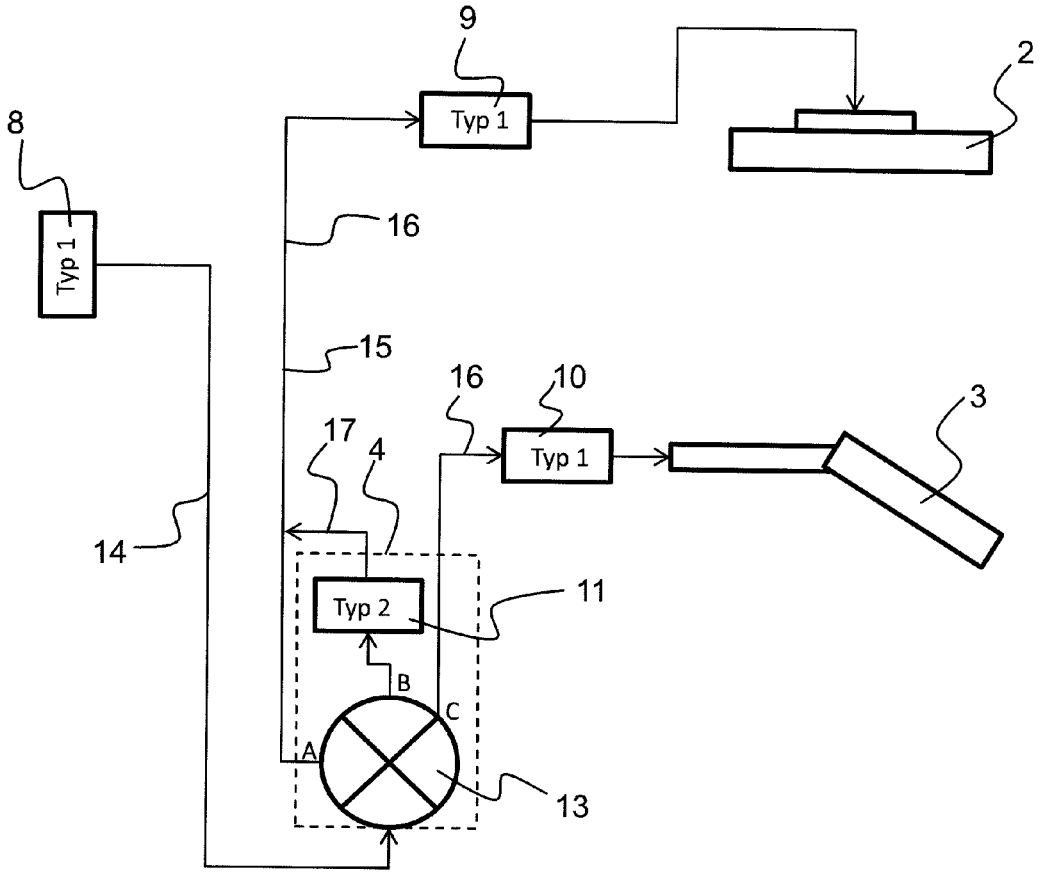
FIG. 2 is a schematic circuit diagram of a first embodiment.

A first embodiment of the present invention is now shown in FIG. 2, in which first flow restrictor 8, second flow restrictor 9, and third flow restrictor 10 are all of type 1 and thereby have the same flow rate restriction. In other words, these three flow restrictors 8, 9, 10 have the same maximum allowable flow rate. Furthermore, fourth flow restrictor 11 is of type 2, which is different from type 1. In the shown example, fourth flow restrictor 11 has a reduced flow rate compared with type 1. Fourth flow restrictor 11 is integrated into the housing of changeover device 4. The mixed water flowing in through first flow restrictor 8 is conveyed via a first conduit channel 14 of conduit 5 to changeover device 4 and there distributed correspondingly according to switching states A, B, or C. In the case of switching state A, the inflowing mixed water is conveyed via a direct line connection through second conduit channel 15 to second flow restrictor 9 and then further to overhead shower head 2. In this respect, first conduit channel 14 and second conduit channel 15 can be run parallel to one another at least in sections in a dual-flow conduit 5. In switching state A, therefore, the mixed water is delivered to overhead shower head 2 with the type 1 allowable maximum flow rate. In switching state B, the mixed water inflowing over first conduit channel 14 with a series connection of fourth flow restrictor 11 and thereby over an indirect conduit path 17 is conveyed further to second conduit channel 15 and overhead shower head 2. In this respect, the flowing water volume experiences a flow restriction, however, which is predetermined by the type 2 fourth flow restrictor. In position C, the inflowing mixed water is conveyed further to hand shower 3, whereby water flows exclusively through first flow restrictor 8 and third flow restrictor 10 of type 1. The water conveyed to hand shower 3 thus experiences only a reduction of the flow rate to the type 1 maximum allowable flow rate.

Figure 3:
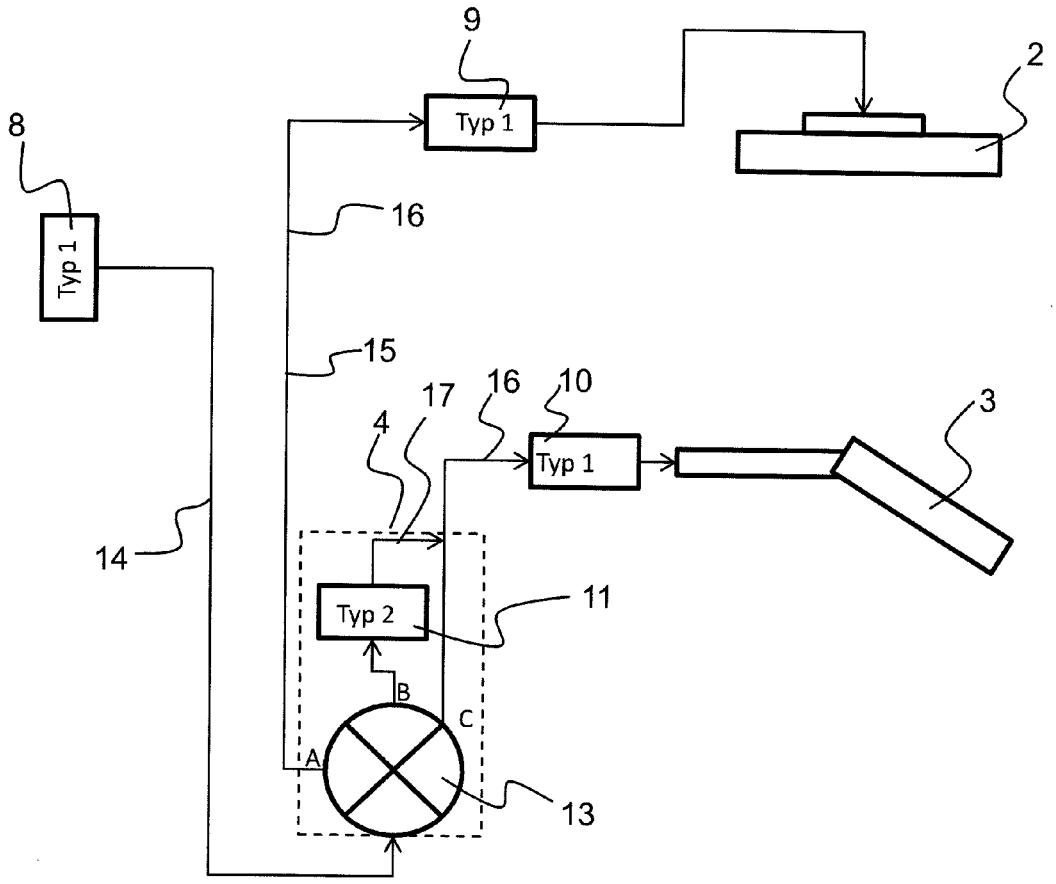
FIG. 3 is a schematic circuit diagram of a second embodiment.

Another variant of the present invention is illustrated in FIG. 3, in which in switching state B the supplied mixed water is conveyed with a series connection of fourth flow restrictor 11 with a reduced flow rate to hand shower 3. In this embodiment, therefore, the hand shower can be operated alternatively with an increased first flow rate or a reduced second flow rate.

Figure 4:
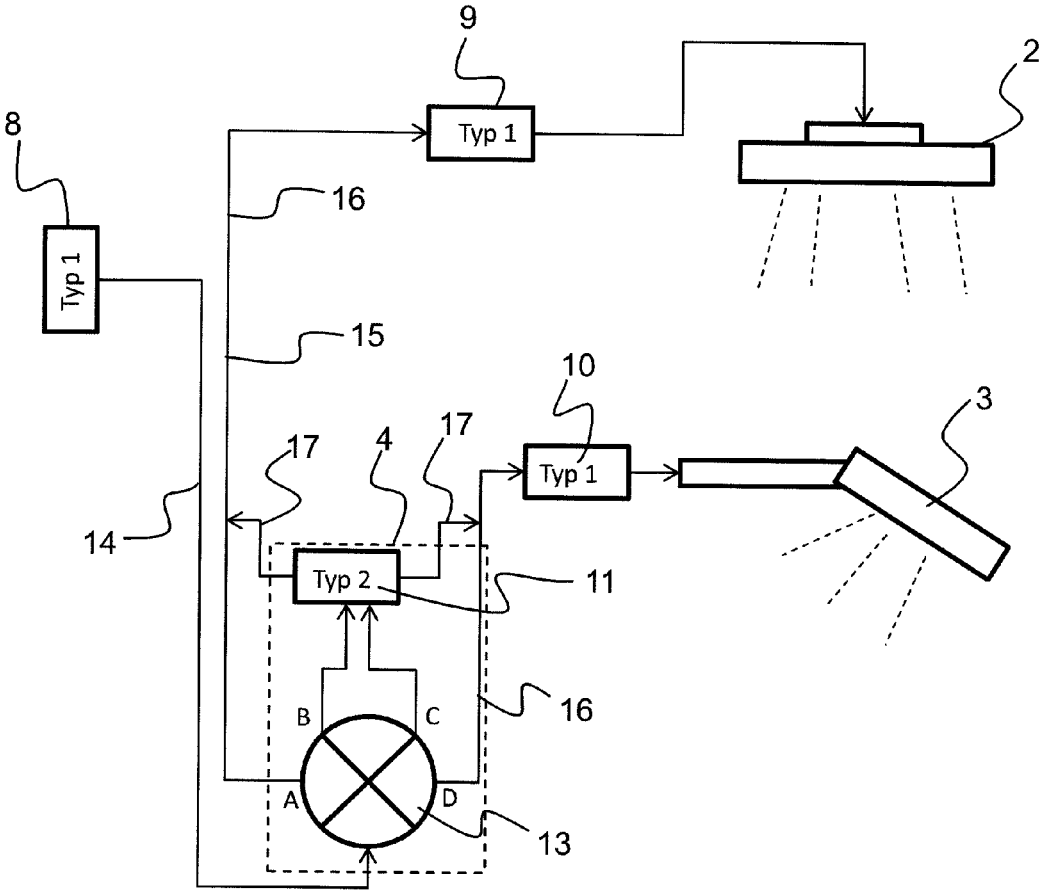
FIG. 4 is a schematic circuit diagram of a third embodiment.

Finally, an embodiment is illustrated in FIG. 4, in which fourth flow restrictor 11 as in the previous embodiments is integrated into the housing of changeover device 4. In this case, four switching states A, B, C, and D are now provided. Switching states A and D, adjacent to one another, provide a delivery of the mixed water with the first flow restriction to overhead shower head 2 or hand shower 3. The other two adjacent switching states B and C provide a delivery of the mixed water with a reduced second flow restriction to overhead shower head 2 or hand shower 3. Because of the adjacent arrangement, it is possible, for example, to switch from A to B and thereby to reduce steadily the flow rate of overhead shower head 2. The same is possible with switching from D to C in regard to hand shower 3. With switching from B to C, accordingly a redirection of the mixed water flow occurs with the reduced second flow restriction from overhead shower head 2 to hand shower 3.

Therefore, it should be pointed out that the present invention is not limited to the illustrated exemplary embodiments. Rather numerous variations of the invention within the scope of the claims are possible. An especially user-friendly switching between a first flow rate restriction and a precisely defined reduced flow rate restriction can occur with the present shower system of the invention. As a result, the acceptance of such a resource saving system is increased, because the showering process can be carried out without loss of comfort with a simultaneously reduced mixed water consumption.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A shower system comprising:

a wall connection;

a changeover device;

a conduit connectable to the wall connection, the conduit connecting the wall connection to the changeover device; and an overhead shower head and a hand shower to which water is supplied alternatively via the changeover device;

a first flow restrictor adapted to limit a maximum flow rate, with a first flow restriction, is arranged in an area of the wall connection;

a second and third flow restrictor, each having the first flow restriction, being arranged in an area of the overhead shower head and hand shower, respectively; and at least one fourth flow restrictor with a second flow restriction is arranged in an area of the changeover device, wherein the changeover device provides at least one first direct line connection between the wall connection and at least the overhead shower head or hand shower, and wherein the changeover device provides a second indirect line connection with a series connection of the fourth flow restrictor.

2. The shower system according to claim 1, wherein the wall connection is a mixed water connection.

3. The shower system according to claim 1, wherein the second flow restriction provides a lower flow rate than the first flow restriction.

4. The shower system according to claim 1, wherein the fourth flow restrictor is integrated into the changeover device.

5. The shower system according to claim 1, wherein the changeover device has at least three switching states, of which at least one switching state connects the fourth flow restrictor in series with either the second flow restrictor or the third flow restrictor and causes the second flow restriction.

6. The shower system according to claim 1, wherein the wall connection is disposed above the changeover device.

7. The shower system according to claim 1, wherein the conduit is made dual-flow at least in part.

8. The shower system according to claim 1, wherein switching states of the changeover device are configured so that a steady change in the flow rates occurs within the limits of the first and second flow restriction.

9. A shower system comprising:

a wall connection;

a changeover device;

a conduit connectable to the wall connection, the conduit connecting the wall connection to the changeover device; and an overhead shower head and a hand shower to which water is supplied alternatively via the changeover device;

a first flow restrictor adapted to limit a maximum flow rate, with a first flow restriction, is arranged in an area of the wall connection;

a second and third flow restrictor, each having the first flow restriction, being arranged in an area of the overhead shower head and hand shower, respectively; and at least one fourth flow restrictor with at least one second flow restriction is arranged in an area of the changeover device, wherein the changeover device provides at least one first direct line connection between the wall connection and at least the overhead shower head or hand shower, and wherein the changeover device provides a second indirect line connection with a series connection of the fourth flow restrictor, such that the changeover device has different operating states in which a fluid is flowable from the changeover device directly to either of the second flow restrictor or the third flow restrictor or is flowable from the changeover device to the fourth flow restrictor before flowing to either of the second flow restrictor or the third flow restrictor.

* * * * *